US008269581B2

(12) United States Patent
Fukamachi et al.

(10) Patent No.: US 8,269,581 B2
(45) Date of Patent: Sep. 18, 2012

(54) BAND-PASS FILTER, HIGH-FREQUENCY COMPONENT, AND COMMUNICATION APPARATUS

(75) Inventors: Keisuke Fukamachi, Saitama (JP); Shigeru Kemmochi, Saitama (JP)

(73) Assignee: Hitachi Metals, Ltd., Tokyo (JP)

( * ) Notice: Subject to any disclaimer, the term of this patent is extended or adjusted under 35 U.S.C. 154(b) by 715 days.

(21) Appl. No.: 12/277,473

(22) Filed: Nov. 25, 2008

(65) Prior Publication Data

US 2009/0160582 A1 Jun. 25, 2009

(30) Foreign Application Priority Data

Nov. 29, 2007 (JP) ..... 2007-308109
Oct. 24, 2008 (JP) ..... 2008-274039

(51) Int. Cl.
*H01P 1/203* (2006.01)
*H01P 7/08* (2006.01)

(52) U.S. Cl. ..... 333/204; 333/219

(58) Field of Classification Search ..... 333/202, 333/204, 24 C, 167, 168, 175, 176, 185, 205, 333/219, 235

See application file for complete search history.

(56) References Cited

U.S. PATENT DOCUMENTS 5,612,656 A 3/1997 Sakamoto et al.
5,621,366 A 4/1997 Gu et al.
5,949,304 A * 9/1999 Heine et al. ..... 333/175
6,289,204 B1 * 9/2001 Estes et al. ..... 455/78
7,116,186 B2 * 10/2006 Chen ..... 333/126

FOREIGN PATENT DOCUMENTS

| | | |
|---|---|---|
| EP | 1 111 707 | 6/2001 |
| JP | 04-43703 | 2/1992 |
| JP | 6-53704 | 2/1994 |
| JP | 09-294001 | 11/1997 |

OTHER PUBLICATIONS

European Search Report from European Patent Office dated Mar. 3, 2009, for Application No. 08020724.4-1248, 5 pages.

* cited by examiner

*Primary Examiner* — Benny Lee
*Assistant Examiner* — Gerald Stevens
(74) *Attorney, Agent, or Firm* — Finnegan, Henderson, Farabow, Garrett & Dunner, LLP

(57) ABSTRACT

A band-pass filter according to the present invention includes two or more resonant lines arranged side by side in a direction orthogonal to a laminating direction in a laminate substrate formed by laminating plural dielectric layers. Each of the resonant lines has a first coil pattern portion formed in the dielectric layers and a second coil pattern portion formed in the dielectric layers different from the dielectric layers in which the first coil pattern portion is formed. The first and second coil pattern portions are connected in series and formed in a spiral shape. At least one of the first and second coil pattern portions is formed as parallel lines in the plural dielectric layers. According to such a configuration, a band-pass filter that is reduced in size and reduced in loss is provided.

9 Claims, 9 Drawing Sheets

BAND-PASS FILTER, HIGH-FREQUENCY COMPONENT, AND COMMUNICATION APPARATUS

BACKGROUND OF THE INVENTION

1. Field of the Invention

The present invention relates to band-pass filters used in radio communication apparatuses and the like for wireless LAN and the like for performing radio transmission between mobile communication apparatuses such as cellular phones and between electronic or electric apparatuses and relates to high-frequency components and communication apparatuses using the band-pass filters.

2. Description of the Related Art

Nowadays, data communication by wireless LAN represented by the IEEE802.11 standard is widely used. The wireless LAN is adopted as signal transmitting means that replaces wired communication between electronic apparatuses such as personal computers (PCs), peripheral equipment of the PC such as printers and hard disks, facsimiles, standard televisions (SDTVs), high definition televisions (HDTV), and cellular phones, in automobiles, and in airplanes. Radio data transmission is performed between respective kinds of electronic apparatuses.

A high-frequency circuit used in a multi-band communication apparatus adopting such a wireless LAN includes one antenna that can perform transmission and reception with two communication systems (IEEE802.11a and IEEE802.11b and/or IEEE802.11g) having different frequency bands and a high-frequency switch that switches connection to a transmission side circuit and a reception side circuit. The high-frequency circuit performs switching of transmission side circuits and reception side circuits of the two communication systems. According to a reduction in size and improvement of functions of radio apparatuses, there is an increasing demand for a reduction in size of high-frequency components, which realize the high-frequency circuit, while integrating a large number of high-frequency components. It is essential to reduce the size of the respective high-frequency components.

Among such high-frequency components, a band-pass filter that selectively causes signal in a predetermined band to pass is an important component of a communication apparatus. The band-pass filter is arranged at a front end of an antenna circuit, between transmission and reception circuits, and the like and used for removing unnecessary waves present near an outside of the pass band.

For example, Japanese Patent Laid-Open No. 6-53704 discloses a laminated band-pass filter. In the band-pass filter disclosed in Japanese Patent Laid-Open No. 6-53704, plural coil electrodes are connected to one another to form spiral electrodes. The spiral electrodes are electromagnetically coupled. A reduction in size of the band-pass filter is realized by such a configuration.

However, in the band-pass filter disclosed in Patent Application Laid-Open No. 6-53704, since the spiral electrodes are still long, loss cannot be sufficiently reduced. Further, in the band-pass filter disclosed in Patent Application Laid-Open No. 6-53704, it is likely that impedance changes because of "misalignment" in a laminating process and a filter characteristic fluctuates. In other words, when coil electrodes formed in respective dielectric layers are misaligned in an in-plane direction, an effective inner diameter of a coil viewed from a projecting direction (a winding axis direction) deviates from a design value and the impedance changes. In this way, the laminated band-pass filter in which electrodes of a resonator are formed over plural layers has a problem of characteristic fluctuation involved in laminating misalignment.

SUMMARY OF THE INVENTION

Therefore, it is an object of the present invention to provide a band-pass filter that can reduce loss and can be reduced in size and a high-frequency component and a communication apparatus using the band-pass filter. It is another object of the present invention to suppress fluctuation in a filter characteristic due to laminating misalignment in such a band-pass filter.

The band-pass filter according to the present invention is a band-pass filter including two or more resonant lines arranged side by side in a direction orthogonal to a laminating direction in a laminate substrate formed by laminating plural dielectric layers. Each of the resonant lines has at least a first coil pattern portion formed in the dielectric layers and a second coil pattern portion formed in dielectric layers different from the dielectric layers in which the first coil pattern portion is formed. The resonant line is formed in a spiral shape by connecting the first and second coil pattern portions in series. At least one of the first and second coil pattern portions is formed as parallel lines in the plural dielectric layers. According to such a configuration, it is possible to realize a reduction in size and a reduction in loss of the band-pass filter.

It is preferable that, in the band-pass filter, at least one line among the parallel lines has width larger than that of the other lines of the parallel lines. According to such a configuration, it is possible to suppress fluctuation in a filter characteristic due to laminating misalignment.

Moreover, it is preferable that, in the band-pass filter, at least one line among the parallel lines has width larger than that of the other lines of the parallel lines such that the line spreads to an inner side of the resonant lines formed in the spiral shape.

Furthermore, it is preferable that, in the band-pass filter, the line having width larger than that of the other lines is arranged on an intermediate layer among the plural dielectric layers in which the resonant lines are formed. The intermediate layer means a layer excluding upper end and lower end layers in the laminating direction among the plural dielectric layers in which the resonant lines are formed. When the line having the large width is arranged on the intermediate layer, it is possible to further suppress the influence due to laminating misalignment.

The high-frequency component according to the present invention is a high-frequency component in which a high-frequency circuit used in a communication apparatus is configured by using a laminate obtained by forming an electrode pattern in plural dielectric layers and an element mounted on the surface of the laminate. The high-frequency circuit has a band-pass filter. The band-pass filter according to the present invention is used as the band-pass filter.

It is preferable that, in the high-frequency component, the high-frequency circuit has a low-noise amplifier and the band-pass filter is connected to an input side of the low-noise amplifier. Since the band-pass filter has low loss, it is suitable to arrange the band-pass filter on the input side of the low-noise amplifier.

Moreover, it is preferable that, in the high-frequency component, a band-pass filter configured by using linear resonant lines is connected to an output side of the low-noise amplifier. Furthermore, it is possible to realize improvement of sensitivity of a reception signal by arranging a band-pass filter excellent in an attenuation characteristic configured by using the linear resonant lines on the output side of the low-noise amplifier.

The communication apparatus according to the present invention is configured by using the band-pass filter or the high-frequency component.

According to the present invention, it is possible to provide a small and low-loss band-pass filter and a high-frequency component and a communication apparatus using the band-pass filter.

DESCRIPTION OF THE PREFERRED EMBODIMENTS

Embodiments of the present invention are explained below with reference to the accompanying drawings. However, the present invention is not limited to the embodiments.

Figure 1:
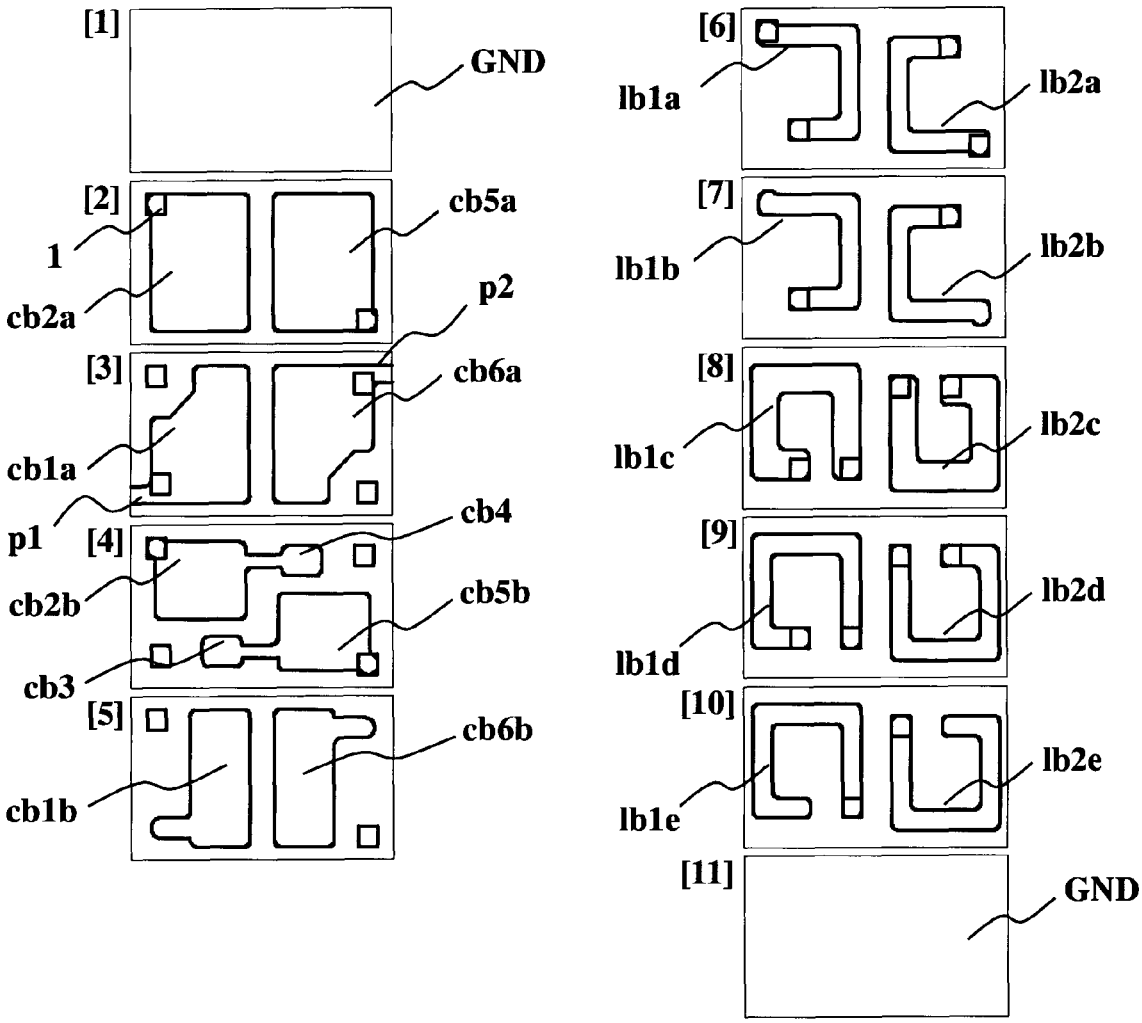
FIG. 1 is a sheet-exploded view for showing electrode arrangement of a band-pass filter according to an embodiment of the present invention.

In FIG. 1, conductor patterns of respective layers of a laminated band-pass filter according to an embodiment of the present invention are shown. The band-pass filter formed on a ceramic laminate substrate having the conductor patterns shown in FIG. 1 is formed of a ceramic dielectric material LTCC (Low Temperature Co-fired Ceramics) that can be sintered at, for example, low temperature equal to or lower than 1000° C. The band-pass filter can be manufactured by printing a conductive paste of Ag, Cu, or the like having low resistivity to form a predetermined electrode pattern on a green sheet having the thickness of 10 μm to 200 μm, integrally laminating plural green sheets as appropriate, and sintering the green sheets. High-frequency components such as a front end module can be manufactured by a ceramic laminate substrate manufacturing process or the like same as that for the band-pass filter.

As the dielectric material, for example, a material containing Al, Si, and Sr as main components and containing Ti, Bi, Cu, Mn, Na, and K as sub-components, a material containing Al, Si, and Sr as main components and containing Ca, Pb, Na, and K as sub-components, a material containing Al, Mg, Si, and Gd, or a material containing Al, Si, Zr, and Mg is used. A material having a dielectric constant of about 5 to 15 is used.

For the dielectric layers forming the laminate substrate, besides the ceramic dielectric material, it is also possible to use a composite material obtained by mixing a resin material or resin and ceramic dielectric powder.

The ceramic laminate substrate may be manufactured by using an HTCC (High Temperature Co-fired Ceramics) technique. In other words, the ceramic laminate substrate may be formed by using a dielectric material mainly containing $Al_2O_3$ and a metal conductor that can be sintered at high temperature such as tungsten or molybdenum.

When the band-pass filter is configured by the ceramic laminate substrate, pattern electrodes for an inductance element, a capacitance element, line, and a ground electrode are appropriately formed in the respective layers, and via conductors are formed between the layers to configure a desired circuit.

The band-pass filter according to the embodiment shown in FIG. 1 includes eleven dielectric layers. In FIG. 1, the first to eleventh dielectric layers are indicated by [1] to [11]. The first layer as a top layer and the eleventh layer as a bottom layer are dielectric layers in which ground electrodes are formed. Conductor patterns for a capacitance element are mainly formed in the second to fifth layers. Conductor patterns for an inductance element are mainly formed in the sixth to tenth layers.

Figure 2:
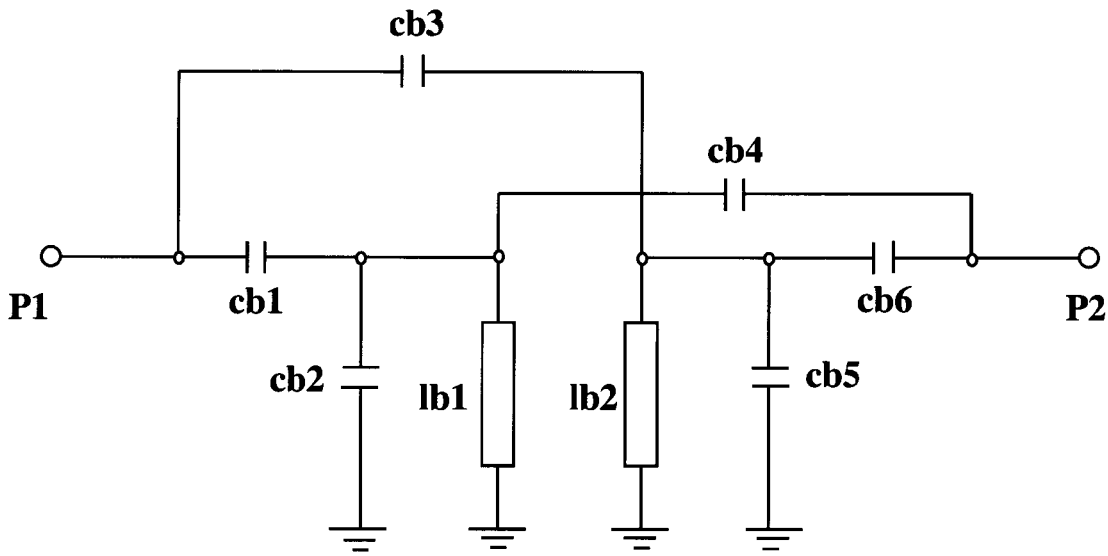
FIG. 2 is an equivalent circuit diagram of the band-pass filter according to the embodiment.

FIG. 2 is a diagram of an equivalent circuit of the band-pass filter configured by the laminate shown in FIG. 1. The band-pass filter includes lines lb1 and lb2 as resonant lines and capacitance elements cb1 to cb6. An input/output capacitor cb1 is connected between an input/output port P1 and the line lb1. A ground capacitor cb2 is connected between the line lb1 and the ground. An input/output capacitor cb6 is connected between an input/output port P2 and the line lb2. A ground capacitor cb5 is connected between the line lb2 and the ground. A coupling capacitor cb3 is connected between the input/output port P1 and the line lb2. A coupling capacitor cb4 is connected between the input/output port P2 and the line lb1.

The equivalent circuit of the band-pass filter shown in FIG. 1 is shown in FIG. 2. However, the band-pass filter according to the present invention is not limited to this. For example, the coupling capacitors cb3 and cb4 can be omitted. In this case, capacitor electrode patterns cb3 and cb4 shown in the fourth layer in FIG. 1 are unnecessary.

The dielectric layers are laminated in order from the eleventh layer to the first layer. A laminating direction of the layers is a direction orthogonal to the paper surface of FIG. 1. The resonant lines lb1 formed by lines lb1*a* to lb1*e* and the resonant line lb2 formed by lines lb2*a* to lb2*e* are arranged side by side in a direction orthogonal to the laminating direction (a direction in the paper surface of FIG. 1). Not only the band-pass filter including the two resonant lines as shown in FIG. 1 but also a band-pass filter including two or more resonant lines arranged side by side can be configured.

In the embodiment shown in FIG. 1, ends of a first coil pattern portion formed in the sixth layer and the seventh layer are connected in parallel to form parallel lines. Ends of a second coil pattern portion formed in the eighth to tenth layers are connected in parallel to form parallel lines. Shapes of the parallel lines forming the second coil pattern portion are substantially the same except the sizes of the widths thereof. The first coil pattern portion in the sixth layer and the seventh layer and the coil pattern portion in the eighth to tenth layers are connected in series to form a spiral inductance element. In this embodiment, the first and second coil pattern portions are formed as parallel lines, respectively, to reduce resistance components of conductors, reduce loss, and increase a Q value.

Both the first and second coil pattern portions do not have to be parallel lines. The effect of the reduction in loss is displayed if at least one of the first and second coil pattern portions is formed as parallel lines in the plural dielectric layers. However, to sufficiently display the effect of the reduction in loss, it is more preferable that both the first and second coil pattern portions are parallel lines.

The resonant lines may further include a coil pattern portion in addition to the first and second coil pattern portions. In this case, it is more preferable that all the coil pattern portions are parallel lines.

Compared with a linear inductance element used in a general band-pass filter, a larger inductance component is easily realized when the spiral inductance element is formed as in the present invention. Therefore, assuming that an inductance component of the same value is formed, since the size of the inductance element itself can be reduced, it is possible to reduce the size of the entire band-pass filter and realize a reduction in size of a composite high-frequency component formed by using the band-pass filter.

The band-pass filter according to this embodiment shown in FIG. 1 is explained more in detail for each of the layers. In the figure, fine square portions indicate via conductors 1. The first layer is a ground layer in an entire area of which a ground electrode is formed. Rectangular capacitance electrodes cb2*a* and cb5*a* formed side by side in the second layer in a direction orthogonal to the laminating direction form ground capacitors between the capacitance electrodes and the first layer as the ground layer (GND). The ground capacitors correspond to the capacitors cb2 and cb5 of the equivalent circuit diagram of the band-pass filter shown in FIG. 2. Capacitance electrodes cb1*a* and cb6*a* formed in the third layer and capacitance electrodes cb1*b* and cb6*b* formed in the fifth layer form capacitors with the capacitance electrodes cb2*a* and cb5*a* formed in the second layer and capacitance electrodes cb2*b* and cb5*b* formed in the fourth layer, respectively. The capacitors correspond to the capacitors cb1 and cb6 connected to the input/output ports P1 and P2 of the equivalent circuit diagram of the band-pass filter shown in FIG. 2.

In the third layer, input/output electrodes p1 and p2 connected to the input/output ports P1 and P2 are extended to sides in positions point-symmetrical with respect to the center of a substantially rectangular area forming the band-pass filter, i.e., diagonal positions. The input/output electrodes p1 and p2 are respectively connected to the capacitance electrodes cb1*a* and cb6*a* to form an integral electrode pattern.

In the fourth layer, a capacitance electrode cb4 connected to the capacitance electrode cb2*b* by connection line is formed. The capacitance electrode cb4 forms a capacitor with the capacitance electrode cb6*a* formed in the third layer and the capacitance electrode cb6*b* formed in the fifth layer. The capacitor corresponds to the coupling capacitor cb4 of the equivalent circuit diagram of the band-pass filter shown in FIG. 2. In the fourth layer, a capacitance electrode cb3 also connected to the capacitance electrode cb5*b* by connection line is formed. The capacitance electrode cb3 forms a capacitor with the capacitance electrode cb1*a* formed in the third layer and the capacitance electrode cb1*b* formed in the fifth layer. The capacitor corresponds to the coupling capacitor cb3 of the equivalent circuit diagram of the band-pass filter shown in FIG. 2.

The connection line that connects the capacitance electrode cb2*b* and the capacitance electrode cb4 and the connection line that connects the capacitance electrode cb5*b* and the capacitance electrode cb3 are formed thinner than electrodes on both sides to which the connection lines are connected. Both end sides of the connection lines formed thin in this way are set to overlap, viewed from the laminating direction, the capacitance electrodes formed in the third layer and the fifth layer. In other words, connecting portions of the capacitance electrodes cb2 and cb4 and the connection lines are set, viewed from the laminating direction, on inner sides of the capacitance electrodes cb1*a*, cb1*b*, cb6*a*, and cb6*b*.

Similarly, connecting portions of the capacitor electrodes cb5*b* and cb3 and the connection lines are set, viewed from the laminating direction, on inner sides (in electrode surfaces) of the capacitance electrodes cb1*a*, cb1*b*, cb6*a*, and cb6*b*.

According to such a configuration, it is possible to reduce interference with other electrodes and minimize capacity fluctuation when laminating misalignment occurs.

Lines of the first coil pattern portion formed in the sixth layer and the seventh layer are connected in parallel. Lines of the second coil pattern portion formed in the eighth to tenth layers are connected in parallel. The first coil pattern portion formed as parallel lines in the sixth layer and the seventh layer and the second coil pattern portion formed as parallel lines in the eighth to tenth layers are connected in series to form resonant lines as spiral inductance elements.

Figure 3:
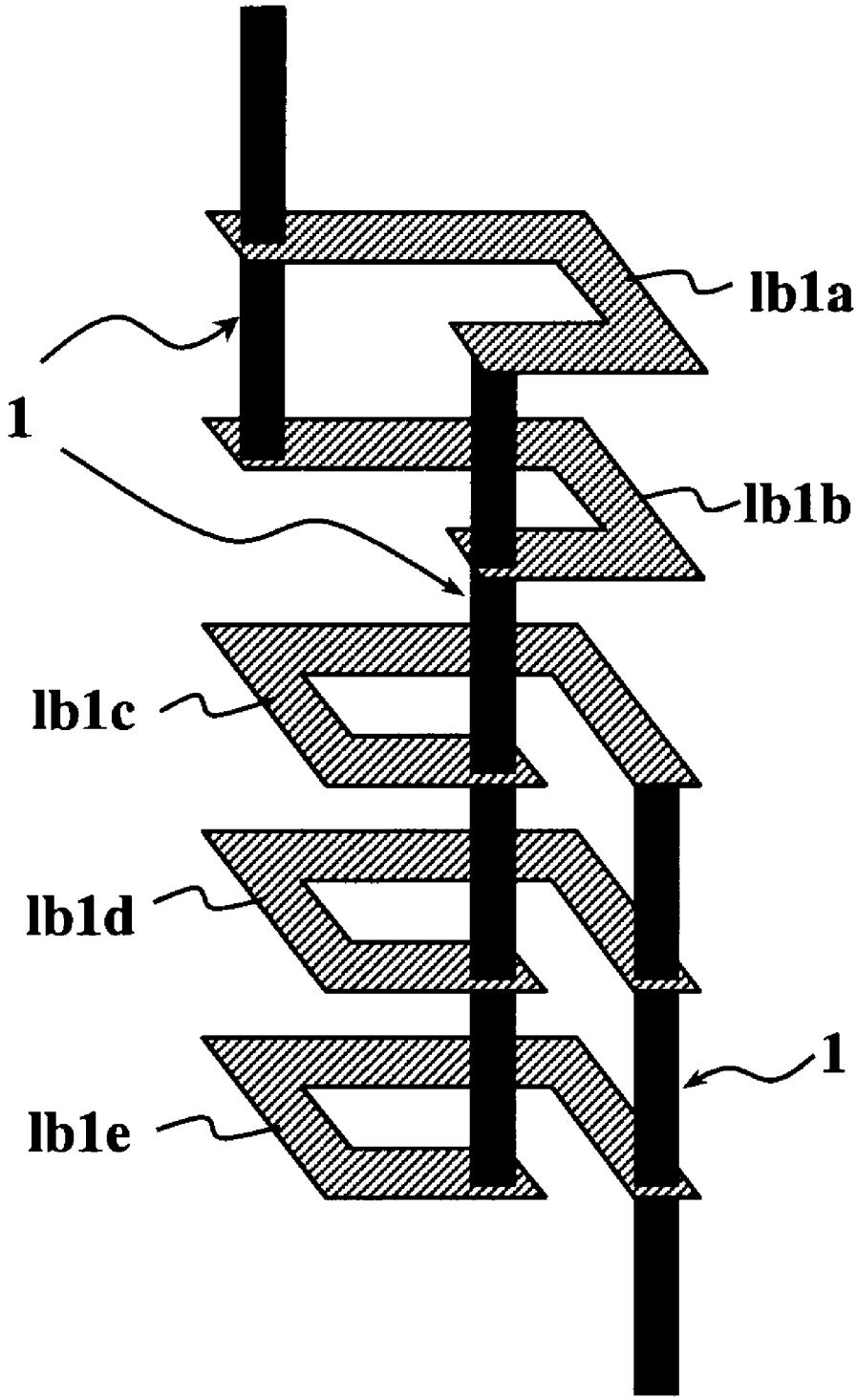
FIG. 3 is a perspective schematic diagram of resonant lines of a laminate substrate viewed from a side of the laminate substrate.

The parallel lines are explained. FIG. 3 is a schematic diagram (a perspective view) of a connection state of the resonant lines on the left side of the laminate substrate shown in FIG. 1. Ends of the line lb1*a* formed in the sixth layer and ends of the line lb1*b* formed in the seventh layer are connected in parallel by the via conductors 1, respectively, to form parallel lines. Such parallel lines have the same number of turns, external shape, and internal shape. The parallel lines have the same electrode pattern shape. The lines lb1*a* and lb1*b* connected in parallel are integrated and form a part of a coil pattern (the first coil pattern portion).

On the other hand, ends of the line lb1*c* formed in the eighth layer, ends of the line lb1*d* formed in the ninth layer, and ends of the line lb1*e* formed in the tenth layer are connected in parallel by via conductors to form parallel lines. The parallel lines have substantially the same electrode pattern shapes. The lines lb1*c* to lb1*e* connected in parallel are integrated and form another part of the coil pattern (the second coil pattern portion). The line lb1*c* formed in the eighth layer has width different from the width of the lines lb1*d* and lb1*e* but has the number of turns and an external shape same as those of the lines lb1*d* and lb1*e*. The first coil pattern portion formed by the lines lb1*a* and lb1*b* connected in parallel and the second coil pattern portion formed by the lines lb1*c*, lb1*d*, and lb1*e* connected in parallel are connected in series to form resonant lines in a spiral shape. The resonant lines on the right side of the laminate substrate shown in FIG. 1 electromagnetically coupled to the resonant lines on the left side are formed in the same manner.

C-shaped lines of about ⅝ turn formed in the sixth layer form a part of the rectangular resonant lines lb1 and lb2 viewed from the laminating direction. In this embodiment, the line lb1*a* and the line lb2*a* are arranged with one sides thereof set in parallel to each other. A degree of coupling of the resonant lines changes according to a space between the one sides. According to the change, a pass characteristic of the band-pass filter also changes. Therefore, in designing the resonant lines, the space only has to be appropriately changed.

Similarly, lines of about ⅝ turn forming a part of the resonant lines lb1 and lb2 are formed in the seventh layer. The lines formed in the seventh layer having a shape same as the shape of the lines formed in the sixth layer are arranged to overlap the lines formed in the sixth layer. The lines in the seventh layer and the lines in the sixth layer are connected in parallel by via conductors.

Substantially rectangular lines of about ⅞ turn forming another part of the resonant lines lb1 and lb2 are formed in the eighth layer. In this embodiment, the width of the line lb1*c* and the line lb2*c* formed in the same dielectric layer and arranged side by side is set larger than the width of lines formed in other dielectric layers. This is for the purpose of preventing a filter characteristic from fluctuating because of laminating misalignment.

Specifically, the width of the line lb1*c* is set large such that an inner side of the spiral resonant lines (coils) is narrower than that of the other lines of the parallel lines, i.e., such that the line lb1*c* spreads to the inner side of the resonant lines formed in the spiral shape. Therefore, the line lb1*c* has an external shape and the number of turns same as those of the other lines lb1*d* and lb1*e* forming the second coil pattern portion but has a different internal shape.

Similarly, the width of the line lb2*c* is set large such that an inner side of the spiral resonant lines is narrower than that of the other lines. Therefore, the line lb2*c* has an external shape and the number of turns same as those of the other lines lb2*d* and lb2*e* forming the second coil pattern portion but has a different internal shape.

Sides forming external shapes of the lines lb1*a* and lb1*b* forming the first coil pattern portion are formed to overlap sides forming an external shape of the line lb1*c* having the large width. The same is true for a relation among the lines lb2*a*, lb2*b*, and lb2*c*. In other words, the lines of the respective coil pattern portions forming the spiral resonant lines are formed such that external shapes of the coils are fixed as a whole. Only shapes on inner sides of the coils of the lines lb1*c* and lb2*c* are different.

It is also possible to set the line width large such that the lines spread to the inner sides and the outer sides of the coils. However, when the lines are set large to the outer side, the space between the electromagnetically coupled resonant lines is reduced only in that portion and the degree of coupling changes. Therefore, it is more preferable to set the line width large such that the lines spread to the inner sides of the coils as shown in FIG. 1. Effects of arrangement of the lines having the large width are explained later.

As shown in FIG. 1, the lines (lb1*c* and lb2*c*) having the width larger than that of the other lines (lb1*a*, lb1*b*, lb1*d*, lb1*e*, lb2*a*, lb2*b*, lb2*d*, and lb2*e*) are arranged on the intermediate layer (in FIG. 1, the eighth layer) of the plural dielectric layers (the sixth to tenth layers) in which the resonant lines are formed. However, the present invention is not limited to this. It is also possible to set the width of the lines arranged on the other layers large. The intermediate layer means layers (the seventh to ninth layers) excluding the sixth layer at the upper end in the laminating direction and the tenth layer at the lower end in the laminating direction among the plural dielectric layers (the sixth to tenth layers) in which the resonant lines are formed.

Similarly, substantially rectangular lines of about ⅞ turn forming another part of the resonant lines lb1 and lb2 are formed in the ninth layer and the tenth layer. The respective lines in the eighth to tenth layers are connected in parallel by via conductors. The eleventh layer is a ground layer in an entire area of which a ground electrode is formed. However, the ground layer is not always essential. When the ground layer is omitted, the impedance of the lines arranged in the sixth to tenth layers increases. Therefore, when large impedance is necessary, the eleventh layer as the ground layer can be omitted.

The respective lines of the first and second coil pattern portions forming the resonant line lb1 and the respective lines of the first and second coil pattern portions forming the resonant line lb2 area arranged, in all the dielectric layers in which the lines are formed, to be opposed to each other in parallel linear portions and have the same space in the respective layers. This makes it possible to improve coupling between the resonant lines.

In this embodiment, the first and second coil pattern portions are formed substantially point-symmetrical with respect to the center point of the band-pass filter. However, it is also possible to form the first and second coil pattern portions line-symmetrically. This makes it possible to flexibly change coupling between the resonant lines and increase a degree of flexibility in design.

The resonant lines lb1 and lb2 and electrodes for forming the ground capacitors cb2 and cb5 and the input/output capacitors cb1 and cb6 of the resonant lines are separately formed on both sides across the center of a band-pass filter forming area and are arranged to overlap each other to realize a reduction in size.

A shape of the resonant lines viewed from the laminating direction is not limited to the rectangular shape shown in FIG. 1 and may be, for example, a circular shape. The shape can be appropriately changed. For example, when it is desired to improve the coupling of the resonant lines, the resonant lines are preferably adjacent to each other in the linear portions. Therefore, the shape of the resonant lines is preferably a rectangular shape. The rectangular shape also includes a shape with radii by rounding a corner as shown in FIG. 1. In order to form the band-pass filter without waste in terms of a space, the shape of the resonant lines viewed from the laminating direction is preferably a rectangular shape. When an electric field distribution in the resonant lines is taken into account, in general, electric fields concentrate on corner portions of the resonant lines and loss occurs. Consequently, Q of the resonant lines may fall. When characteristic deterioration due to this fall in Q is conspicuous, the resonant lines are preferably formed in a circular shape.

In the embodiment shown in FIG. 1, the lines formed in the sixth layer and the seventh layer are connected in parallel and the lines formed in the eighth to tenth layers are connected in parallel. However, other configurations are also possible. For example, it is also possible that the tenth layer is omitted, parallel lines are formed by lines formed in two layers of the eighth and ninth layers, and the numbers of parallel lines of the respective coil patterns are set the same. It is within the scope of the technical idea of the invention to appropriately change a design according to demands for an inductance value and a filter characteristic necessary for the resonant lines.

Figure 4A:
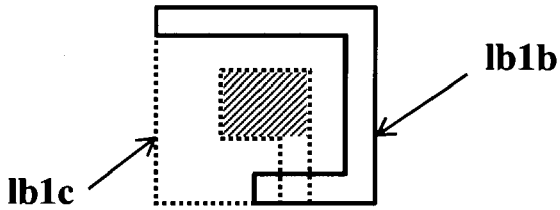
FIGS. 4A to 4D are diagrams of overlapping states of lines forming the resonant lines.

In the band-pass filter according to the present invention, the line having width larger than that of the other lines among the lines forming the resonant lines is arranged to suppress fluctuation in impedance due to laminating misalignment. This is explained below with reference to FIGS. 4A to 4D. In FIG. 4A, the line lb1*b* in the seventh layer and the line lb1*c* in the eighth layer shown in FIG. 1 are superimposed.

A dimension on an inner side of a coil of a substantially rectangular coil pattern portion is equivalent to an inner diameter of the coil. Such a dimension is important. This is because the inductance of the coil depends on an amount of change in an interlinkage flux amount of the coil with respect to a very small change in an electric current flowing through the coil. The dimension on the inner side of the coil indicates an inner diameter in the case of a coil having a circular shape viewed from a coil winding axis direction and indicates a space between opposed sides on the inner side of the coil in the case of the rectangular shape shown in the figure. An area of a hatched portion on the inner side in FIG. 4A relates to the amount of change in the interlinkage flux amount.

Figure 4B:
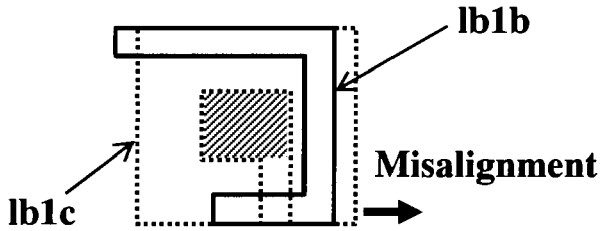
Figure 4C:
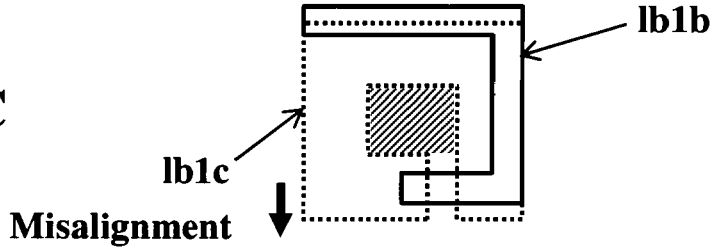
Figure 4D:
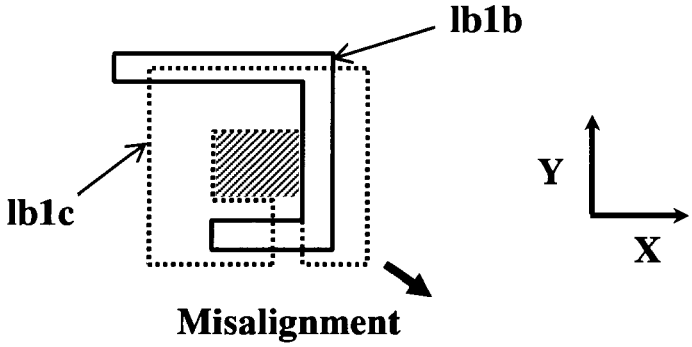

In FIG. 4B, the upper and lower lines are misaligned in an X direction in a laminate surface. In FIG. 4C, the upper and lower lines are misaligned in a Y direction in the laminate surface. In FIG. 4D, the upper and lower lines are obliquely misaligned in the laminate surface. As it is seen from FIGS. 4A to 4D, an air-core sectional area of the hatched portion on the inner side of the wound lines (an effective area forming an air-core portion projected from the laminating direction) is substantially invariable even when there is laminating misalignment. This is because the width of the line lb1*c* is set large such that the line lb1*c* spreads to the inner side.

By setting one line among the parallel lines larger than that of the other parallel lines, it is possible to suppress characteristic fluctuation due to laminating misalignment with a range of a difference in width. The width of two or more lines may be set larger than that of the other parallel lines among the parallel lines. However, between the lines having the large width, laminating misalignment leads to a decrease in an effective area of a portion on the inner side of a coil. Therefore, it is more preferable that the line having the large width is formed only in one layer in the laminating layers, i.e., one line having the large width is formed for one resonant line.

To prevent the air-core sectional area from changing, a shape of the line having the large width is preferably a substantially rectangular shape exceeding ¾ turn. This is because, in the line having such a shape, since a line substantially closed on the inner side of the coil by two pairs of sides is formed, even when the other lines are misaligned in any one of directions in a plane (an XY plane), a substantial change in the air-core sectional area is suppressed.

In general, laminating misalignment often occurs in one direction. Therefore, in a line farther away from the layer in which the line having the large width is formed, the line is closer to a limit of absorption of the laminating misalignment. Therefore, if the number of laminated layers is the same, to cope with the laminating misalignment, it is preferable to arrange the line having the large width in the intermediate layer. From such a viewpoint, it is more preferable to arrange the line having the large width in a dielectric layer in the center when the number of dielectric layers forming the resonant lines is an odd number and to arrange the line in any one of a pair of dielectric layers located in the center when the number of dielectric layers is an even number.

From the same reason, in the parallel lines, it is preferable to set the width of a line in a layer adjacent to another coil pattern portion. In this way, the width of at least one line (in the case of this example, the lines lb1*c* and lb2*c*) of the parallel lines is set larger than that of the other lines (lb1*a*, lb1*b*, lb1*d*, and lb1*e* and lb2*a*, lb2*b*, lb2*d*, and lb2*e*). This makes it possible to prevent fluctuation in impedance due to laminating misalignment in a manufacturing process and characteristic fluctuation in the band-pass filter.

The band-pass filter according to the present invention may be configured as a stand-alone band-pass filter but may be used in a high-frequency circuit that requires a band-pass filter. For example, in a high-frequency component having a high-frequency circuit that includes a laminate obtained by forming electrode patterns in plural dielectric layers and a chip element such as a semiconductor element or an inductor mounted on the surface of the laminate and is used for a communication apparatus, the band-pass filter according to the present invention is used as a band-pass filter of the high-frequency circuit.

Examples of the high-frequency components include an antenna switch module that switches transmission and reception of radio communication of a wireless LAN and the like and a composite module obtained by integrating the antenna switch module and a high-frequency amplifier module. A representative configuration of such a high-frequency component is a high-frequency component including at least one antenna terminal connected to an antenna, at least one transmission terminal to which a transmission signal is inputted, at least one reception terminal from which a reception signal is outputted, and at least one switch circuit that switches connection of the antenna terminal and the transmission terminal or the reception terminal.

Figure 5:
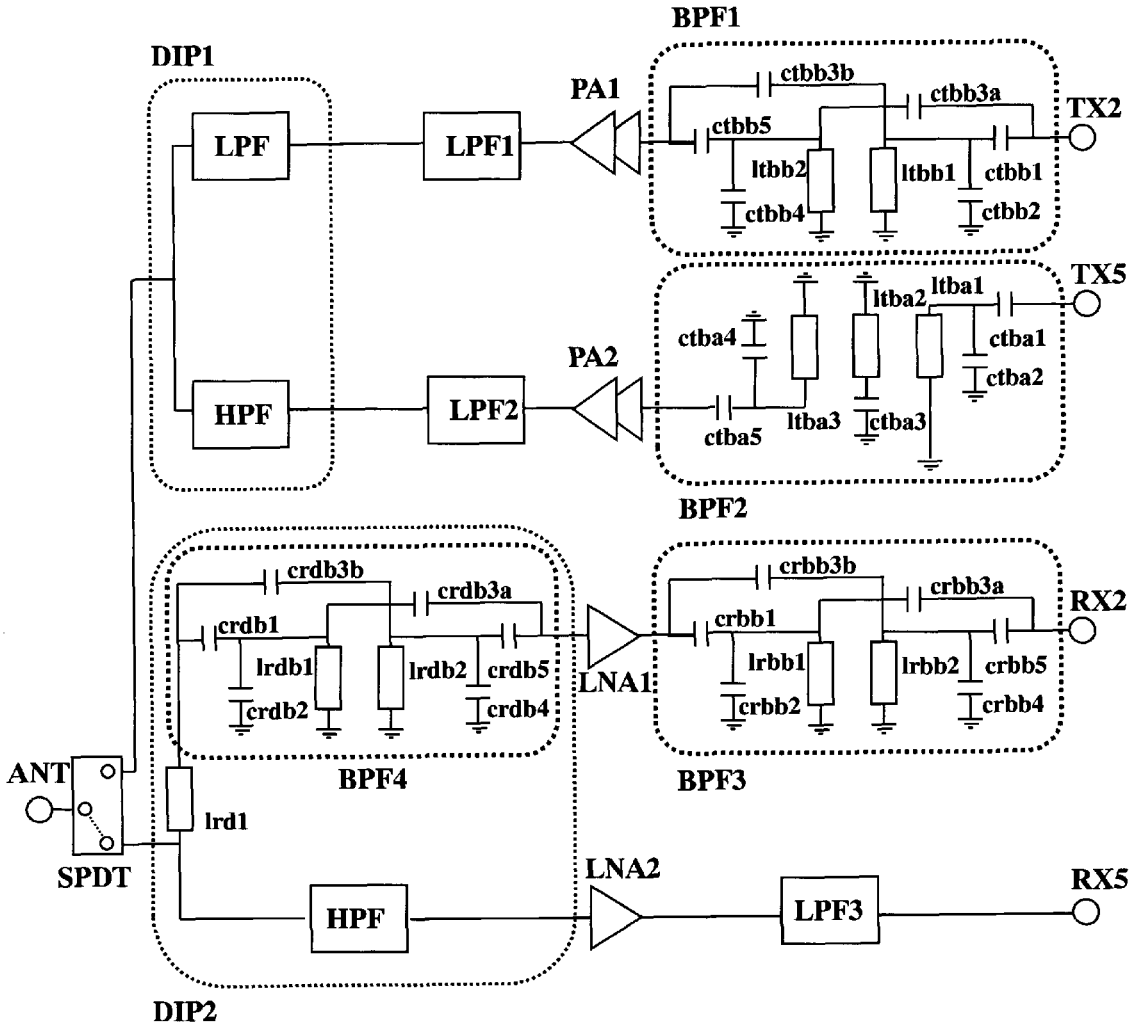
FIG. 5 is an equivalent circuit diagram of a front end module according to an embodiment of the present invention.
Figure 6A:
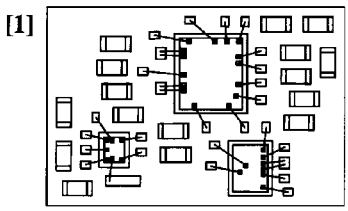
FIGS. 6A to 6O are sheet-exploded views of the front end module according to the embodiment.
Figure 6B:
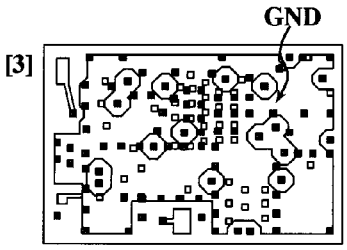
Figure 6C:
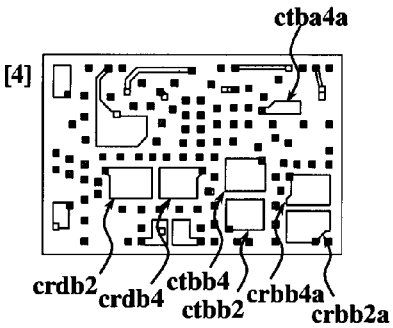
Figure 6D:
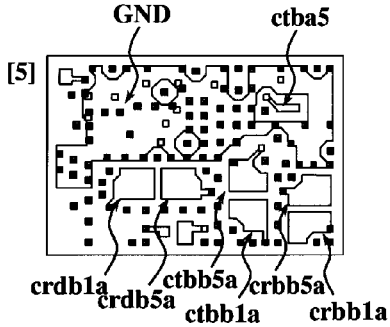
Figure 6E:
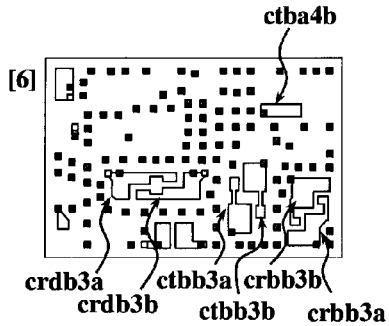
Figure 6F:
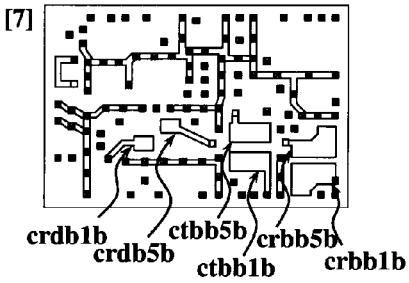
Figure 6G:
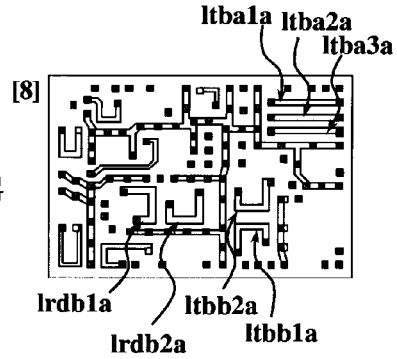
Figure 6H:
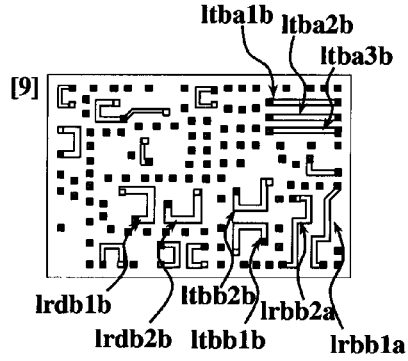
Figure 6I:
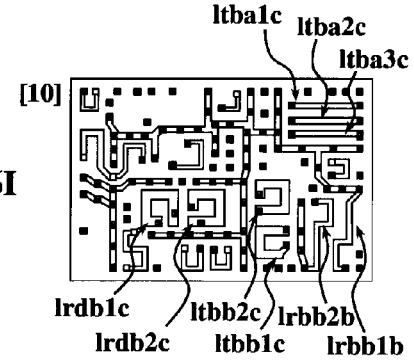
Figure 6J:
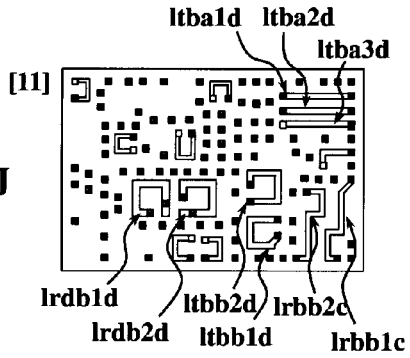
Figure 6K:
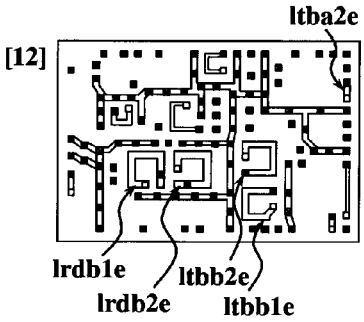
Figure 6N:
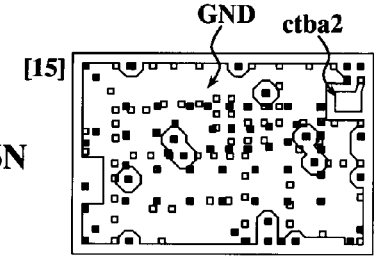
Figure 6L:
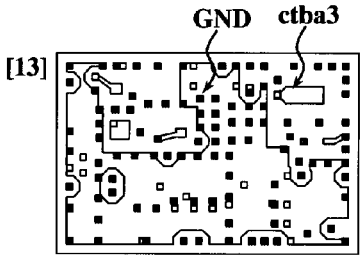
Figure 6O:
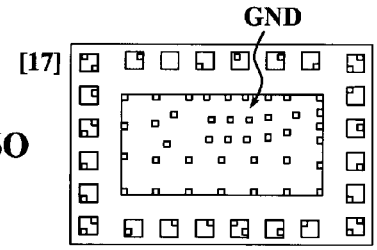
Figure 6M:
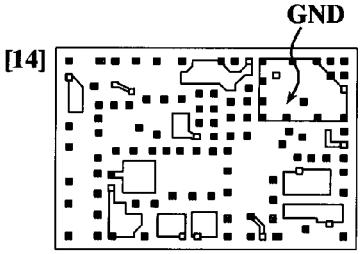

As an example of the high-frequency component configured by using the laminate obtained by forming the electrode patterns in the plural dielectric layers and the elements mounted on the surface of the laminate, an example of a dual-band front end module for wireless LAN is shown in FIG. 5 and FIGS. 6A to 6O.

FIG. 5 is an equivalent circuit diagram of the front end module. The front end module shown in FIG. 5 includes an antenna terminal ANT connected to an antenna, a transmission terminal TX2 to which a transmission signal in a 2.4 GHz band is inputted, a transmission terminal TX5 to which a transmission signal in a 5 GHz band is inputted, a reception terminal RX2 from which a reception signal in the 2.4 GHz band is outputted, a reception terminal RX5 from which a reception signal in the 5 GHz band is outputted, and a switch circuit SPDT that switches connection of the antenna terminal ANT and the transmission terminals TX2 and TX5 or the reception terminals RX2 and RX5.

The antenna terminal ANT is connected to a common terminal of the switch circuit SPDT. A diplexer DIP1 on a transmission side and a diplexer DIP2 on a reception side are connected to two switching terminals of the switch circuit SPDT, respectively. The diplexer DIP1 on the transmission side includes a high-pass filter portion HPF and a low-pass filter portion LPF. The diplexer DIP2 on the reception side includes a high-pass filter portion HPF and a band-pass filter portion BPF4.

A high-frequency amplifier circuit PA1 that amplifies the transmission signal in the 2.4 GHz band is connected between the diplexer DIP1 on the transmission side and the transmission terminal TX2. A high-frequency amplifier circuit PA2 that amplifies the transmission signal in the 5 GHz band is connected between the diplexer DIP1 on the transmission side and the transmission terminal TX5.

Band-pass filters BPF1 and BPF2 are connected to input sides of the high-frequency amplifier circuits PA1 and PA2, respectively. Low-pass filters LPF1 and LPF2 are connected to output sides of the high-frequency amplifier circuits PA1 and PA2, respectively. On the other hand, a low-noise amplifier circuit LNA1 that amplifies the reception signal in the 2.4 GHz band is connected between the diplexer DIP2 on the reception side and the reception terminal RX2. A low-noise amplifier circuit LNA2 that amplifies the reception signal in the 5 GHz band is connected between the diplexer DIP2 on the reception side and the reception terminal RX5.

A band-pass filter BPF3 is connected to an output side of the low-noise amplifier circuit LNA1. A low-pass filter LPF3 is connected to an output side of the low-noise amplifier circuit LNA2. In the front end module shown in FIG. 5, the high-frequency circuit has the low-noise amplifier circuit LNA1 in a reception path in the 2.4 GHz band on a low-frequency side and the band-pass filter portion BPF4 according to the present invention is connected to an input side of the low-noise amplifier.

FIGS. 6A to 6O are laminating pattern diagrams of the laminate of the front end module having the equivalent circuit shown in FIG. 5. The band-pass filter according to the present invention only has to be used for the band-pass filter BPF1 and the band-pass filter portion BPF4 forming a part of the diplexer DIP2 on the reception side. IC chips of the switch circuit SPDT, the high-frequency amplifier circuits PA1 and PA2, and the low-noise amplifier circuits LNA1 and LNA2 are mounted on the laminate substrate.

Figure 7:
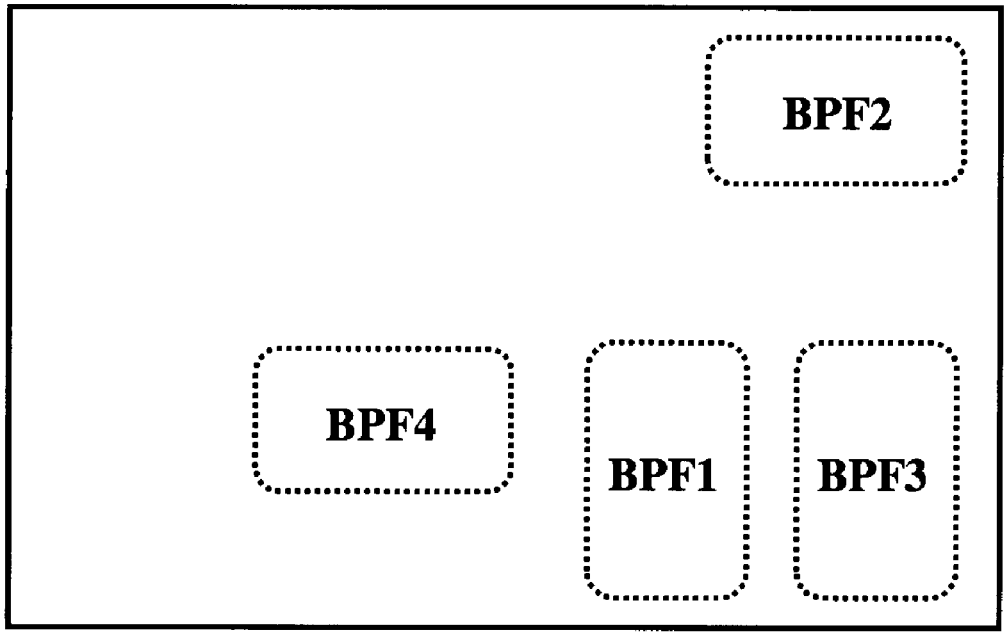
FIG. 7 is a diagram of the arrangement of the band-pass filter in the front end module according to the embodiment.

The arrangement of the band-pass filters viewed from the laminating direction is shown in FIG. 7. In the figure, the band-pass filter BPF1 arranged in the transmission path in the 2.4 GHz band is arranged at the lower right of the center of the laminate. Electrode patterns for LC of the band-pass filter BPF1 and the band-pass filter portion BPF4 are formed from a fourth layer to a twelfth layer sandwiched by a third layer and a thirteenth layer in which ground electrodes are formed.

Lines ltbb1*a*, ltbb1*b*, ltbb2*a*, and ltbb2*b* forming a first coil pattern portion are formed in an eighth layer and a ninth layer. Lines ltbb1*c* to ltbb1*e* and ltbb2*c* to ltbb2*e* forming a second coil pattern portion are formed in tenth to twelfth layers. Capacitance electrodes (ctbb1*a*, ctbb1*b*, ctbb2, ctbb3*a*, ctbb3*b*, ctbb4, ctbb5*a* and ctbb5*b*) forming a coupling capacitor and a ground capacitor for the band-pass filter BPF1 are formed in fourth to seventh layers. Configurations of the lines and the capacitance electrodes forming the band-pass filter BPF1 are the same as those shown in FIG. 1. Therefore, explanation of the configurations is omitted.

In an embodiment shown in FIGS. 6A to 6O, a configuration same as that of the band-pass filter shown in FIG. 1 is used for the band-pass filter portion BPF4 as well. The band-pass filter BPF1 and the band-pass filter portion BPF4 are arranged through plural shield vias and a belt-like shield electrode connected thereto. However, the direction in which coupled resonant lines of the band-pass filter BPF1 and the band-pass filter portion BPF4 are arranged are different by 90 degrees.

The band-pass filter BPF1 and the band-pass filter portion BPF4 are the same as the band-pass filter BPF1, for example, in that ends of the first coil pattern portion formed in the eighth layer and the ninth layer are connected in parallel to form parallel lines and ends of the second coil pattern portion formed in the tenth to twelfth layers are connected in parallel to form parallel lines and in that the first coil pattern portion in the eight layer and the ninth layer and the second coil pattern portion in the tenth to twelfth layers are connected in series to form a spiral inductance element.

The band-pass filter BPF1 and the band-pass filter portion BPF4 formed by using parallel lines are particularly excellent in insertion loss. Lines lrdb1*a*, lrdb1*b*, lrdb2*a*, and lrdb2*b* forming the first coil pattern portion are formed in the eight layer and the ninth layer. Lines lrdb1*c* to lrdb1*e* and lrdb2*c* to lrdb2*e* forming the second coil pattern portion are formed in the tenth to twelfth layers.

Capacitance electrodes (crdb1*a*, crdb1*b*, crdb2, crdb3*a*, crdb3*b*, crdb4, crdb5*a*, and crdb5*b*) forming a coupling capacitor and a ground capacitor for the band-pass filter portion BPF4 are formed in the fourth to seventh layers. The width of the line lrdb1*c* and the line lrdb2*c* formed in the same dielectric layer (the tenth layer) and arranged side by side is larger than the width of the lines formed in the other dielectric layers.

Via holes for connecting ends of the lines lrdb1*c* to lrdb1*e* and lrdb2*c* to lrdb2*e* forming the second coil pattern portions (ends on the opposite side of ends connected to the first coil pattern) are formed in positions spaced apart from the ends of the lines. With such a configuration, it is possible to suppress characteristic fluctuation due to laminating misalignment.

On the other hand, in the embodiment shown in FIGS. 6A to 6O, in the band-pass filter BPF2 and the band-pass filter BPF3, linear resonant lines are used instead of the spiral resonant lines. Excellent attenuation is obtained in the band-pass filters. The band-pass filter BPF3 formed by using the linear resonant lines is connected to the output side of the low-noise amplifier LNA1.

As shown in FIG. 7, the band-pass filter BPF2 is provided at a corner at the upper right of the laminate and the band-pass filter BPF3 is provided at a corner at the lower right of the laminate. The band-pass filter BPF2 is a band-pass filter including three stages of resonators. The resonators of a linear shape are arranged side by side on the dielectric layer and coupled to each other. The band-pass filter BPF3 is a band-pass filter including two stages of resonators. The resonators of a polygonal line shape are arranged side by side on the dielectric layer and coupled to each other.

The respective resonant line patterns are formed by parallel lines obtained by connecting one ends of line patterns lrbb1*a* to lrbb1*c* and lrbb2*a* to lrbb2*c* of the same shape formed in different dielectric layers. In the resonant lines of the band-pass filter BPF2, lines formed in the eighth to eleventh layers form one resonant line, respectively.

Similarly, in the resonant lines of the band-pass filter BPF3, lines ltba1*a* to ltba1*d*, ltba2*a* to ltba2*d* and ltba3*a* to ltba3*d* of a linear shape formed in the ninth to eleventh layers, respectively, form one resonant line. In the seventh layer and the thirteenth layer that are adjacent to and sandwich the eighth to twelfth layers, in which the first coil pattern portion and the second coil pattern portion of the band-pass filter BPF1 and the fourth band-pass filter portion BPF4 are formed, in the laminating direction, capacitance electrodes and ground electrodes are formed to sandwich the first coil pattern portion and the second coil pattern portion.

On the other hand, in the seventh layer and the twelfth layer that are adjacent to and sandwich the eighth to eleventh layers, in which the resonant lines of the band-pass filter BPF2 are formed, in the laminating direction, capacitance electrodes and ground electrodes that sandwich the layers are not formed. The capacitance electrodes and the ground electrodes are formed in each of the sixth layer or the thirteenth layer via one layer. Similarly, in the eighth layer and the twelfth layer adjacent to the ninth to eleventh layers, in which the resonant lines of the band-pass filter BPF3 are formed, in the laminating direction, capacitor electrodes and ground electrodes that that sandwich the layers are not formed. The capacitance electrodes and the ground electrodes are formed in each of the seventh layer and the thirteenth layer via one layer.

The band-pass filter according to the present invention can be applied to respective band-pass filters in a high-frequency component such as a front end module. However, it is more preferable to connect the band-pass filter to, for example, an input side of an amplifier. In particular, it is more preferable to use the band-pass filter according to the present invention, in which the resonant lines are formed in the spiral shape, as a band-pass filter arranged on an input side of a low-noise amplifier of a reception path and use a band-pass filer, in which resonant lines are formed in a liner shape, as a band-pass filter arranged on an output side of the low-noise amplifier of the reception path.

According to this circuit configuration, it is possible to secure attenuation on the outside of a band of the band-pass filter on the output side of the low-noise amplifier while reducing insertion loss on the input side of the low-noise amplifier using the band-pass filter according to the present invention. Therefore, it is possible to substantially improve reception sensitivity. Such an effect is brought about by arranging, in a high-frequency module including a low-noise amplifier, the band-pass filters having relatively different insertion losses and attenuations before and behind the low-noise amplifier. Therefore, a configuration of the band-pass filters is not limited to the configuration of the band-pass filter according to the present invention and other configurations may be used.

The band-pass filter according to the present invention is applicable not only to the high-frequency module and the front end module but also to a wide variety of other high-frequency components. The band-pass filter according to the present invention and the high-frequency component using the band-pass filter can be expanded to various communication apparatuses. In particular, the band-pass filter according to the present invention can also be applied to a cellular phone, a Bluetooth (registered trademark) communication apparatus, a wireless LAN communication apparatus (802.11a/b/g/n), WIMAX (802.16e), IEEE802.20 (I-burst), and the like that handle high frequencies.

For example, it is possible to form a high-frequency front end module that can use both two communication system of a 2.4 GHz wireless LAN (IEEE802.11b and/or IEEE802.11g) and a 5 GHz wireless LAN (IEEE802.11a) or a high-frequency front end module applicable to the standard of IEEE802.11n and realize a small multi-band communication apparatus including the high-frequency front end module. Communication systems are not limited to the frequency bands and the communication standards described above. It is possible to use the band-pass filter according to the present invention in various communication systems.

The present invention is applicable to not only the two communication systems and is also applicable to a larger number of communication systems by adopting, for example, a form in which the diplexers are further divided into multiple stages. The multi-band communication apparatus can be expanded to, for example, a radio communication apparatus represented by a cellular phone, a personal computer (PC), peripheral equipment of the PC such as a printer, a hard disk, and a broadband router, and home electronics such as a facsimile, a refrigerator, a standard television (SDTV), a high definition television (HDTV), a camera, and a video.

What is claimed is:

1. A band-pass filter including two or more resonant lines arranged side by side in a direction orthogonal to a laminating direction in a laminate substrate formed by laminating plural dielectric layers, wherein each of the two or more resonant lines has: at least a first coil pattern portion formed in a dielectric layer of the plural dielectric layers and a second coil pattern portion formed in another dielectric layer of the plural dielectric layers different from the dielectric layer, in which the first coil pattern portion is formed, and is formed in a spiral shape by connecting the first and second coil pattern portions in series, at least one of the first and second coil pattern portions is formed as parallel lines in the plural dielectric layers, at least a part of lines forming the parallel lines have substantially the same electrode pattern shapes, ends of each of the lines forming the parallel lines are connected via conductors, and at least one line among the parallel lines has a width larger than that of the other lines of the parallel lines.

2. A communication apparatus configured by using the band-pass filter according to claim 1.

3. The band-pass filter according to claim 1, wherein the line having the width larger than that of the other lines is arranged on an intermediate layer among the plural dielectric layers wherein the intermediate layer is located between said dielectric layer and said another dielectric layer.

4. The band-pass filter according to claim 1, wherein the line having the width larger than that of the other lines spreads to an inner side of the corresponding resonant line formed in the corresponding spiral shape.

5. The band-pass filter according to claim 4, wherein the line having the width larger than that of the other lines is arranged on an intermediate layer among the plural dielectric layers wherein the intermediate layer is located between said dielectric layer and said another dielectric layer.

6. A high-frequency component in which a high-frequency circuit used in a communication apparatus is configured by using said laminate substrate obtained by forming an electrode pattern in said plural dielectric layers and an element mounted on the surface of the laminate, wherein the high-frequency circuit has the band-pass filter according to claim 1.

7. The high-frequency component according to claim 6, wherein the high-frequency circuit has a low-noise amplifier, and the band-pass filter is connected to an input side of the low-noise amplifier.

8. The high-frequency component according to claim 7, wherein another band-pass filter configured by using linear resonant lines is connected to an output side of the low-noise amplifier.

9. A communication apparatus configured by using the high-frequency component according to claim 6.

* * * * *